US007936366B2

(12) United States Patent
Trauer et al.

(10) Patent No.: US 7,936,366 B2
(45) Date of Patent: May 3, 2011

(54) THERMAL PRINTER

(75) Inventors: Ricardo Trauer, Curitiba (BR); Marcelino Canelada Campos Filho, Fortaleza (BR); Eduardo Terra Dupuy, Florianópolis (BR); Paulo Ricardo Fonseca Blank, Florianópolis (BR); Fernando Augusto Pereira, Florianópolis (BR); Luis Eduardo Lima Kido, Botucatu (BR)

(73) Assignee: Bematech Industria E Comercio De Equipamentos Electronics S/A, Parana (BR)

( * ) Notice: Subject to any disclaimer, the term of this patent is extended or adjusted under 35 U.S.C. 154(b) by 233 days.

(21) Appl. No.: 12/281,709

(22) PCT Filed: Mar. 6, 2007

(86) PCT No.: PCT/IB2007/050724

§ 371 (c)(1),
(2), (4) Date: Nov. 19, 2008

(87) PCT Pub. No.: WO2007/102120

PCT Pub. Date: Sep. 13, 2007

(65) Prior Publication Data

US 2009/0219375 A1 Sep. 3, 2009

(30) Foreign Application Priority Data

Mar. 6, 2006 (BR) ..... 0600439

(51) Int. Cl.
*B41J 29/13* (2006.01)
*B41J 11/70* (2006.01)

(52) U.S. Cl. ..... 347/222

(58) Field of Classification Search ..... 347/222; 400/691, 693

See application file for complete search history.

(56) References Cited

U.S. PATENT DOCUMENTS

| | | | |
|---|---|---|---|
| 5,135,318 | A | 8/1992 | Hongo |
| 5,808,283 | A | 9/1998 | Stanton et al. |
| 6,118,469 | A | 9/2000 | Hosomi |
| 6,189,788 | B1 | 2/2001 | Sherman et al. |

(Continued)

FOREIGN PATENT DOCUMENTS

| | | | |
|---|---|---|---|
| BG | 61355 | B1 | 6/1997 |

(Continued)

OTHER PUBLICATIONS

Machine-generated translation of JP-11245476, published on Sep. 1999.*

(Continued)

*Primary Examiner* — Huan H Tran
(74) *Attorney, Agent, or Firm* — Lando & Anastasi, LLP

(57) ABSTRACT

A thermal printer including a first chassis, a second chassis, a cutting mechanism and a thermal printing mechanism. The first chassis has a movable blade of the cutting mechanism, a print head of the thermal printing mechanism, and an automatic activation mechanism for moving the movable blade from a platen roller of the thermal printing mechanism. A fixed blade of the cutting mechanism and the platen roller are positioned on the second chassis. The print head is horizontally placed allowing paper to be directed toward a frontal part of the printer, and the platen roller is placed right above the print head. The cutting mechanism is positioned vertically with a slight inclination so that movement of the movable blade is in a direction perpendicular to a line formed between a rotation axis of a cover of the printer and a contract point between the movable blade and the fixed blade.

16 Claims, 18 Drawing Sheets

U.S. PATENT DOCUMENTS

| | | | |
|---|---|---|---|
| 6,352,381 | B1 | 3/2002 | Gonmori et al. |
| 6,474,883 | B1 | 11/2002 | Kawakami et al. |
| 6,556,216 | B1 | 4/2003 | Cato et al. |
| 6,682,239 | B2 | 1/2004 | Mori et al. |
| 6,758,614 | B2 | 7/2004 | Yamada et al. |
| 2003/0029339 | A1 | 2/2003 | Silverbrook |
| 2003/0103793 | A1 | 6/2003 | Murakoshi et al. |
| 2005/0123336 | A1 | 6/2005 | Oshida et al. |
| 2005/0162501 | A1 | 7/2005 | Seo et al. |
| 2006/0104694 | A1 | 5/2006 | Montagutelli |

FOREIGN PATENT DOCUMENTS

| | | | |
|---|---|---|---|
| BR | 990436-9 | A | 4/2001 |
| BR | 0106864-4 | A | 4/2003 |
| BR | 0402032-4 | A | 12/2005 |
| EP | 1114731 | A2 | 11/2001 |
| EP | 1506875 | A2 | 2/2005 |
| EP | 1469998 | B1 | 8/2008 |
| FR | 2845943 | A1 | 4/2004 |
| JP | 5-120567 | | 5/1993 |
| JP | 11-245476 | A | 9/1999 |
| JP | 2001-205896 | A | 7/2001 |
| JP | 2004074812 | A2 | 3/2004 |
| JP | 2004268207 | A2 | 9/2004 |
| JP | 2005-119109 | A | 5/2005 |
| JP | 2006-082315 | | 3/2006 |
| KR | 20-0158715 | | 10/1999 |
| KR | 10-0267732 | | 10/2000 |
| KR | 10-2001-0039109 | | 5/2001 |
| WO | WO 99/66465 | A1 | 12/1999 |
| WO | 0072262 | A1 | 11/2000 |
| WO | WO 03/064163 | A1 | 8/2003 |
| WO | WO 2005/090027 | A1 | 9/2005 |
| WO | WO 2007/102121 | A2 | 9/2007 |

OTHER PUBLICATIONS

Sales Taxes Agreement ICMS 156/94, Paragraph 13, subsection XI, section 11, Dec. 15, 1994 (Brazilian Official Gazette).

Sales Taxes Agreement ICMS 85/01, Paragraph 4, subsections V-VII, Sep. 28, 2001 (103rd ordinary meeting—National Council for Finance Affairs).

Urgency Ordinance No. 28/1999, Norms 3.1 and 3.2.

International Search Report published May 8, 2008 from related PCT Application No. PCT/IB2007/050725.

Written Opinion dated Feb. 21, 2008 from related PCT Application No. PCT/IB2007/050725.

International Search Report published Feb. 28, 2008 from corresponding PCT Application No. PCT/IB2007/050724.

Supplementary European Search Report from corresponding European Application No. EP07713203 dated Sep. 22, 2010.

Extended European Search Report dated Apr. 8, 2010 from European Application No. 07713204.1 and corresponding to International Application No. PCT/IB2007/050725.

* cited by examiner

THERMAL PRINTER

TECHNICAL FIELD

The present invention refers to a technical field of selective printing mechanisms, characterized by selective application of heat to a printing material that is sensitive to heat, which uses a thermal head. More particularly, it refers to mechanisms of easy paper feed with system for automatic alignment of the platen roller, having a thermal head for printing after paper feed, additionally having a system for positioning and aligning of blades for a paper cutting device.

BACKGROUND ART

Printers are peripherals acting as output device widely used for data transfer such as a text or figure from digital files to a physical form like paper. The main types of printers are matrix, thermal, and inkjet, being colored or monochromatic.

However, matrix printers are noisy and inkjet printers do not allow high-speed printing. Thus, the use of thermal printers increased very much over past years, particularly in points of sales, banking terminals, and label printing.

Thermal printers are conventionally composed by a support for printing paper, for instance, from a paper roll, a thermal printing mechanism, and a cutting mechanism, besides cabinet, controlling board, feeding source, and accessories.

Thermal printing mechanisms consist of mechanisms comprising at least one thermal print head and platen roller, which in conjunction heat the desired parts providing darkening of such parts on paper, preferably in thermal paper. Usually, a stepper motor and gears are used to promote the platen roller motion which, then, makes thermal paper to go forward. The thermal printing mechanism can also use a thermal film that, when heated, colors the paper to be printed. Thermal head is a device composed by a matrix of resistances or another element that irradiates heat, in which electrical signals from the controlling board are converted into heat in specific points of the matrix according to what is desired to be printed. Platen roller is pressed on the posterior side of the paper in order to guarantee contact between thermal head and paper, needed for printing.

Cutting mechanisms employed in printers vary from simple small saw, positioned near paper output so that operator cuts paper, to more elaborate cutting mechanisms with automatic activation such as guillotine, circular or helicoidal blades.

Cutting mechanisms like guillotine consist of two relatively flat blades, being one fixed and the other movable. The blades are pressed one against the other by one or more springs, so that by activating the movable bade by a motor and a set of gears the cut is done, such as the sectioning mechanism disclosed on the international application published under no. WO 2005/090027 A1.

Usage of thermal printing mechanisms is convenient due to the quality and speed propitiated. However, conventional mechanisms present difficulties to the operator mainly at the moment of changing the paper roll, because both thermal head and platen roller are fixed to the body that consists of the only chassis in these conventional printers, wherein the operator must manually open the printing mechanism, putting the thermal head away from platen roller, and manually insert paper through printing mechanism and cutting system in a delicate and slow process. In busy establishments, such as big department stores or even fast food chains, these minutes which operator wastes changing the paper roll may represent significant losses of profit by the end of the day. Besides, the waiting time can make clients unsatisfied with the establishment.

In background art there are, thus, several constructive arrangements aiming at making paper change easier and faster. Below, there are some arrangements that propose different dispositions of thermal mechanism and cutting mechanism that have influence on said changing of paper.

For example, patent published under U.S. Pat. No. 6,682,239 B2 discloses a thermal printer unit including a set of thermal head and a platen roller. The Platen roller reception openings disclosed comprise vertical grooves with superior openings, horizontal grooves extending from inferior vertical grooves opposite to thermal head and a projected part above the horizontal fitting towards thermal head. In such openings, platen roller edges are fitted, initially passing through vertical grooves and locating in horizontal grooves, being indirectly pressed by thermal head spring. During printer functioning, the part above horizontal fitting, together with thermal head inclination, provides thermal head positioning in relation to platen roller and printer locking. For printer opening, by means of external force action generated by operator, platen roller edges slide in horizontal and vertical grooves, pushing thermal head and releasing the platen roller passage for printer opening.

Patent published under U.S. Pat. No. 6,758,614 B2 discloses a printing mechanism with platen roller in a chassis provided with a small rotation movement in relation to a second chassis fixed to the covering. Thermal head is disposed on printer body and a lever is disposed on platen roller movable chassis that moves when printer is closed.

Patent published under U.S. Pat. No. 6,118,469 discloses a thermal printer having printer mechanism vertically positioned and, above it, a cutting mechanism with a slight inclination in relation to horizontal direction, wherein thermal head of printing mechanism and movable blade of cutting mechanism are disposed on printer body, and platen roller and fixed blade are positioned on the cover.

Patent application published under number JP 2004-074812 discloses a printer equipped with thermal head of printing mechanism and movable blade of cutting mechanism positioned on printer body, and platen roller and fixed blade are positioned on printer cover by means of a movable chassis pressed by springs. The cutting mechanism is horizontally positioned above the printing mechanism, which is vertically positioned. During opening and closing of printer, the movable chassis of printer cover suffers a small movement for releasing and fitting the mechanisms in the correct position.

Patent application published under number JP 2004-268207 discloses a printer with cutting mechanism like scissors with fixed blade located on body and movable blade located on printer cover. Even if the cutting mechanism stops during cutting movement, printer cover still can be open because the movable blade, that slides on fixed blade during cutting, is located on the cover.

Patent application published under number WO 03/064163 A1 discloses a printer that also tries to solve problem of printer opening, positioning the movable blade on the printer cover and positioning the fixed blade on a second cover disposed on the frontal part of the printer.

Other documents of the background art relate to vertical cutting mechanism such as patent application published under numbers US2005/0162501A1, KR10-2001-0039109 and EP0993955A1.

DISCLOSURE OF INVENTION

Technical Problem

Solutions mentioned on hereinabove documents and others existent on the background art, however, do not conveniently and efficiently solve some problems existing in the technical field of easy paper feed mechanisms having system for automatic alignment of platen roller with thermal printing head after feed and having a system for positioning and alignment of blades for a cutting paper device.

Documents U.S. Pat. No. 6,682,239 B2 and U.S. Pat. No. 6,758,614 B2 disclose printers that can be easily opened due to platen roller positioning on the cover and the thermal head on the printer body. However, it refers to simplified dispositions widely used in printers that do not use a cutting mechanism.

Documents U.S. Pat. No. 6,118,469 and JP 2004-074812 disclose dispositions of printing mechanisms and cutting mechanisms that allow direct opening of the printer with no need of manual distancing, for example, for changing paper roll. However, in situations of self-locking of the movable blade during cut, the movable blade does not allow opening of the printer, requiring an additional device that allows the operator to manually return the movable blade to the initial position. Such apparatus increases the number of mechanism parts, making the printer more expensive; hampering operation by non-skilled operators; and may harm product aesthetics, because an additional cover that will be needed to access this retuning mechanism. Thus, as movable blade self-locking situations may happen for several reasons, for example, due to paper jamming on the cutting mechanism, it is important that the printer allows easy opening even on such situations.

Documents JP 2004-268207 and WO 03/064163 disclose arrangements that try to solve the problem mentioned of obstruction of the cover when the cutting mechanism gets locked. However, the mechanisms disclosed consist of dispositions with the movable blade on the printer cover, presenting discomfort to the operator when opening and, mainly, closing the printer due to additional weight that is put on the cover, further requiring a system for damping such movement in order to avoid damages to mechanisms due to shocks while closing the cover. Besides, there is the need of passage of feeding wires to motor responsible for activating movable blade. In order for such feeding wires not to disturb cover opening, they must pass near rotation axis of cover, what increases costs with wires besides submitting wires to unnecessary efforts, diminishing the life cycle of mechanisms. The arrangement disclosed on document WO 03/064163 further presents the inconvenience of having an additional cover that increases the number of parts subjected to waste and, mainly, renders difficult perfect alignment between the two blades, which is indispensable for the correct functioning of the cutting mechanism.

There are also in the background art printers that adopt other kinds of cutting mechanisms in order to facilitate the opening of the printer cover even in a situation of failure when trying to make the cut, such as circular or helicoidal blade, however, such cutting mechanisms significantly increase printer cost. Some of them, such as mechanism with blade in disc-shape that are very slow to execute the cutting. Besides, many of these mechanisms present life cycle shorter than guillotine-like mechanism for presenting a more complex cutting geometry.

Even though the document no. US 2005/0162501 A1 relates to a movable blade mounted to a cutter holder that are inclined at an oblique cross angle, the cutter unit with several parts, such as passage grove or cutter holder, its complex geometry results in locking of the cutting mechanism in case of paper jamming.

Therefore, as may be seen, there still is a need of an opening mechanism for a thermal printer with cutting mechanism that allows easy and fast printer opening and closing, independent from eventual failures, whenever needed, for example, when operator needs to replace the paper roll, providing also desired alignment between thermal head and platen roller and among blades for the right printer functioning.

Technical Solution

The objective of the present invention, therefore, is to obtain a thermal printer opening mechanism that operates automatically, solving eventual failures in a way that is simple to the operator and, consequently, minimizing necessity of intervention from a trained or skilled operator him/herself.

Another objective of the present invention is to obtain a thermal printer with high availability, minimizing eventual errors that may cause technical interventions for the equipment maintenance.

Another objective of the present invention is to obtain an opening and closing mechanism of thermal printer of easy and fast operation whenever it is necessary, for example, when the operator needs to replace paper roll providing also desired alignment between thermal head and platen roller and among blades for the right printer functioning.

Another objective of the present invention is to obtain an opening mechanism of thermal printer of easy operation that does not need existence of any additional mechanism for manual returning of movable blade in case of cutting mechanism locking that might make difficult printer use for operators with no specific training.

Another objective of the present invention is to obtain an automatic activation mechanism that allows movable blade return after opening the cover in case of cutting mechanism locking and, consequently, increasing operator safety, and also, providing integrity of cutting and printing mechanism.

Besides, another objective of the present invention is to reduce probability of cutting mechanism locking during operation by means of optimized solution of mechanism for activation of movable blade.

In order to achieve objectives hereinabove mentioned and other objectives, the present patent discloses an opening mechanism of thermal printer comprising two chassis, wherein the first chassis that is preferably fixed to the printer body there are the movable blade of cutting mechanism, thermal head of thermal printer mechanism, automatic activation mechanism from movable blade, and platen roller tractioning mechanism; and on the second chassis, that is preferably fixed to the printer cover, there are fixed blade of cutting mechanism, and platen roller of thermal printer mechanism. On the printer cover, there is also a lever for printer opening. Said cover locking is provided by locks sideward located to the first chassis which are rotated when the lever is activated, promoting easy cover opening.

Thermal head is horizontally positioned allowing paper guidance to frontal part of printer, and the platen roller is positioned right above thermal head. On frontal part, before printing mechanism, there is the cutting mechanism on a vertical position slightly inclined so that movement direction of movable blade is perpendicular to line formed between rotation axis of cover and contact point between both blades.

In the best mode of execution, the second chassis has an articulated movement in relation to the cover, in a way that whenever it is needed to open the cover, such chassis spins, distancing blades in a horizontal direction before cover opening movement. Such opening occurs parallel to blades. It allows easy opening of cover even in situations of movable blade locking.

Thus, in case of cutting mechanism locking, operator may open printer withdrawing the element that causes said locking, for example, a scrunched paper. When the cover is opened, the movable blade is taken automatically back to avoid its exposure to the operator. Afterwards, the operator may normally close the printer and continue printing.

In order to prevent such situations from happening, additionally, it is revealed a kinematical gears arrangement of the cutting mechanism, consisting of two helicoidal gears activated by an endless gear disposed between the two helicoidal gears, directly activating each of helicoidal gears.

Advantageous Effects

In conventional printers herein mentioned and others found in background art using guillotine like cutting mechanism, when movable blade advances over fixed blade, said movable blade obstructs cover opening making it necessary a manual returning of movable blade to allow the opening de-obstruction. The thermal printing opening mechanism revealed in the present patent in an innovative way, by generating articulate movement of the second chassis and positioning cutting mechanism perpendicular to the line formed between cover rotation axis and contact point between both blades, makes it easier for operators to use the printer, even if they have no experience in printing operations, once cover opening is never blocked by superposition of movable blade to movement trajectory of fixed blade from cutting mechanism. To open the printer, it is enough for the operator to activate lever and raise cover, like in a normal paper replacement operation.

Such disposition also reduces probability of damages to thermal printer opening mechanism, once there is no possibility of the operator forcing the cover and breaking any of its components, since there are no components obstructing cover opening.

As the cover can open even when movable blade locks in an advanced position, such arrangement could present a risk for operator. To avoid such risk, the blade position sensor identifies the locking allowing motor activation of cutting mechanism at the moment of cover opening, promoting automatic retreat of said movable blade.

Due to this free printer opening and closing arrangement, even when there is a locking on cutting mechanism, the disclosed printer requires no extra technical knowledge from operator. Besides, the present printer presents high availability due to minimizing of the probability of technical interventions for proper functioning.

Furthermore, the gear arrangements of cutting mechanism allows an increase in efficiency of motor force transmission that activates the movable blade that promotes cutting, consequently, avoiding undesired situations of cutting mechanism locking and increasing printer availability.

Fitting geometry between first and second chassis allows all forces coming from cutting mechanisms to be restricted to interface of the two chassis, not overcharging locking mechanism. Thus, the spring of locking mechanism does not need to exert such intense force in order to provide cover closure, making it easier for operator to open and close the printer.

Accommodation revealed from fixed blade in relation to movable blade provides auto-balancing of cutting mechanism, making the efforts uniform between blades, which is essential for cutting uniformity.

Symmetry and independence of locking mechanism allow compensation of small manufacturing errors such as small asymmetry on rod, which is important to guarantee the efforts that the lock has on rod are similar on both sides of printer, providing the same relative positioning between platen roller and thermal head from both sides and, consequently, providing a uniform printing.

Combination of disclosed arrangements is specially desired for equipments with high usage rate, such as big retail stores chains or banking automation, having in mind printer operators are not used to receive specific training for situations of errors in printer operation.

Additionally, there is a reduction of the number of technical calls caused by cutting mechanism locking, which, besides diminishing technical maintenance costs, also increase the time a printer stays in operation.

DESCRIPTION OF DRAWINGS

To facilitate the understanding and execution of the present invention, the following figures are given for illustration purposes and not restricting the final form of the invention. Each component or identical or similar part illustrated is identified by a correspondent number.

BEST MODE

Figure 1:
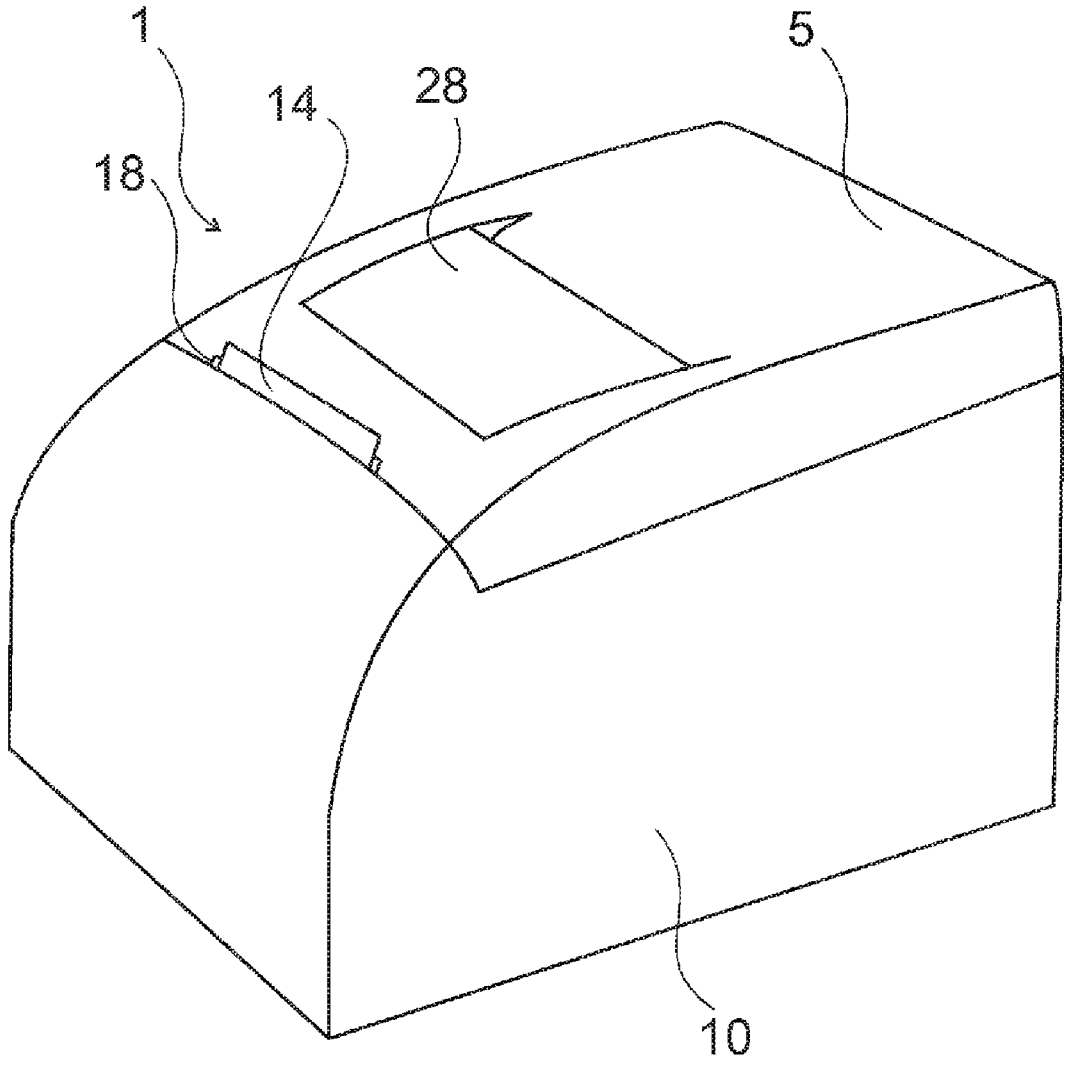
FIG. 1 shows a perspective view of the printer according to the present invention.
Figure 2:
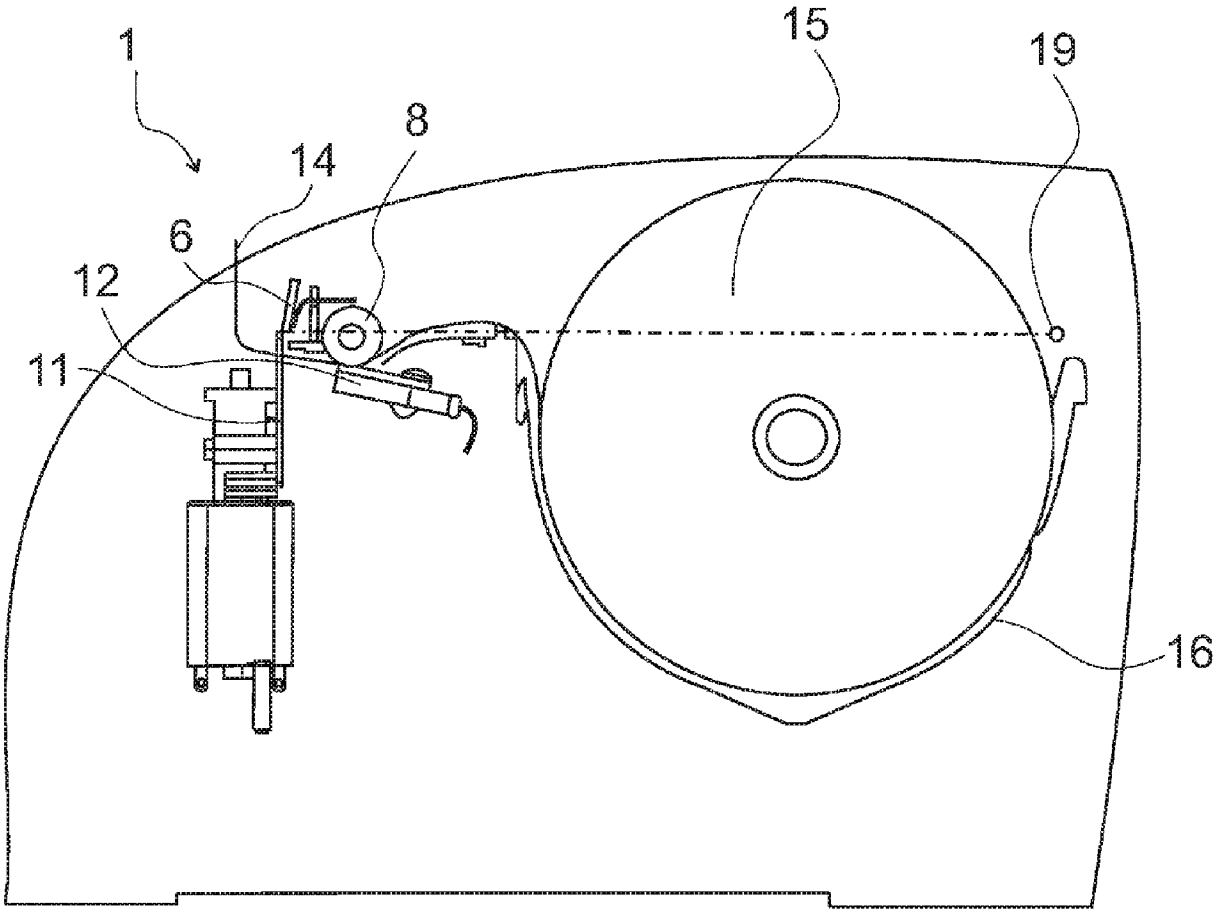
FIG. 2 shows a view of a longitudinal section of the printer without the locking mechanism.
Figure 3:
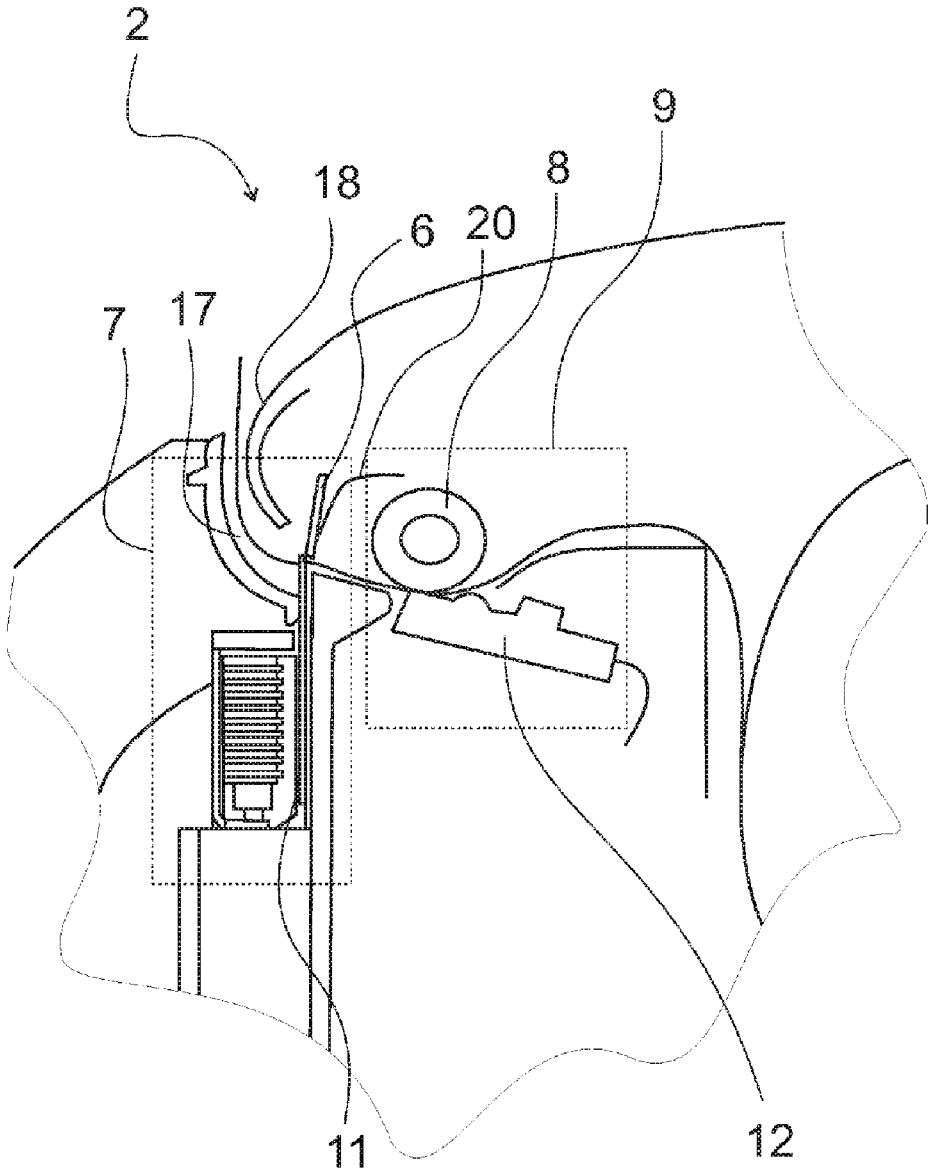
FIG. 3 shows a side view of the printing and cutting mechanism of the thermal printer.
Figure 4:
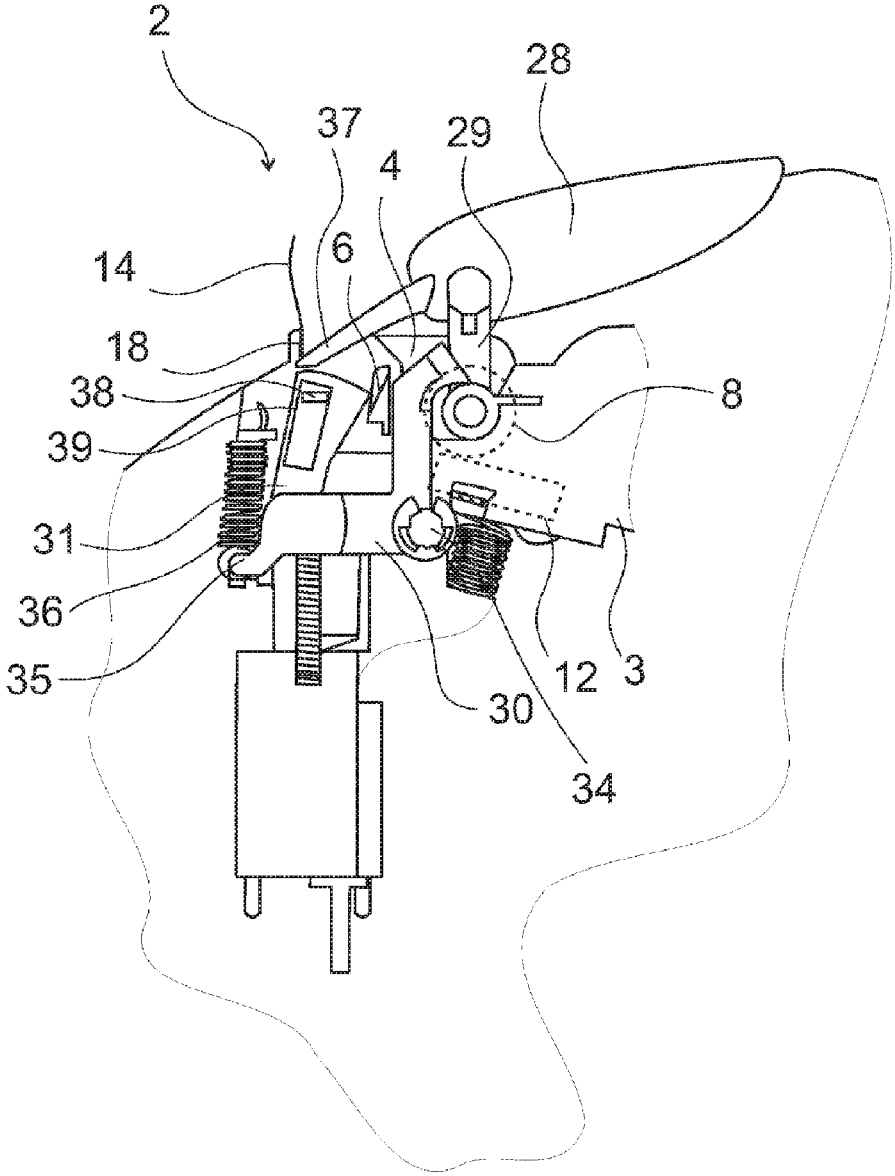
FIG. 4 shows a side view of the opening mechanism from thermal printer according to the best mode of execution of present invention.
Figure 5:
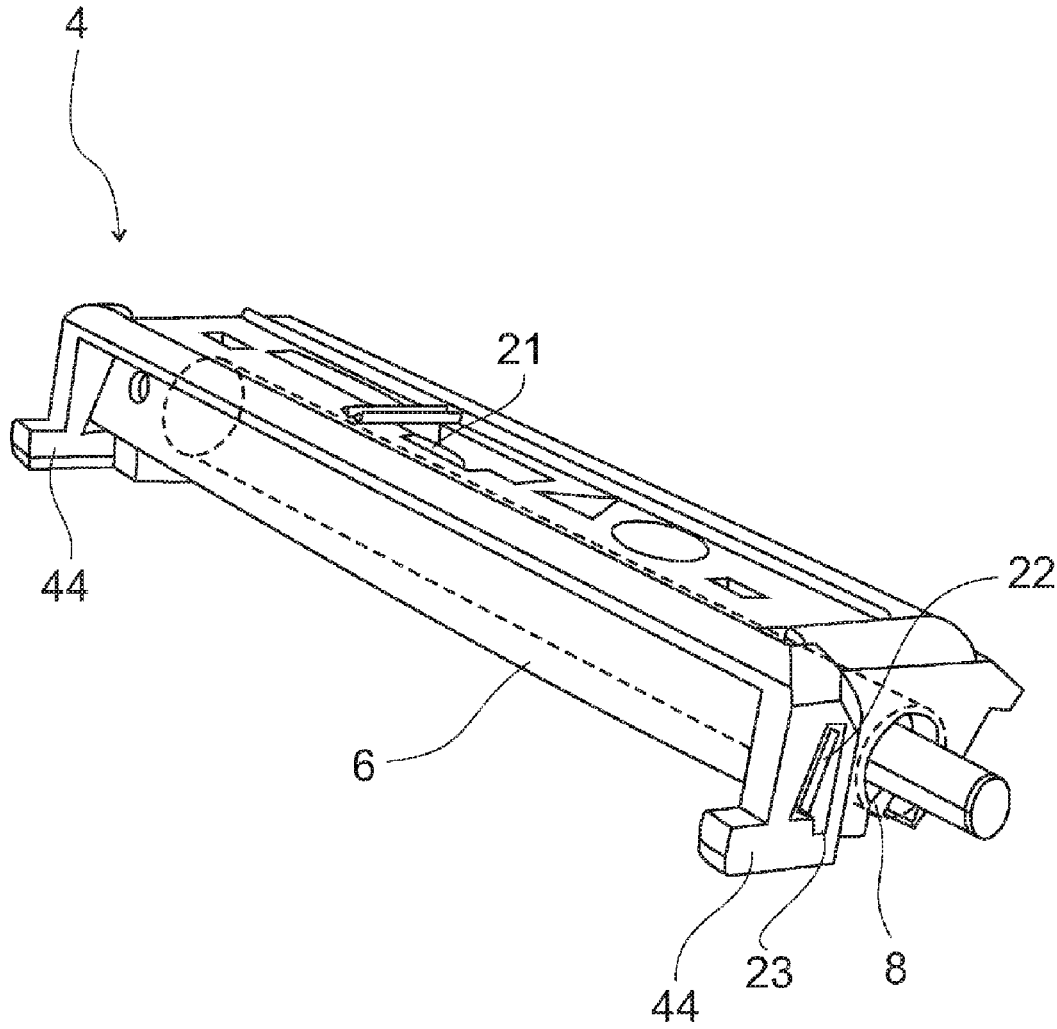
FIG. 5 shows a perspective view of the second chassis from opening mechanism from thermal printer according to best mode of execution of present invention.
Figure 6:
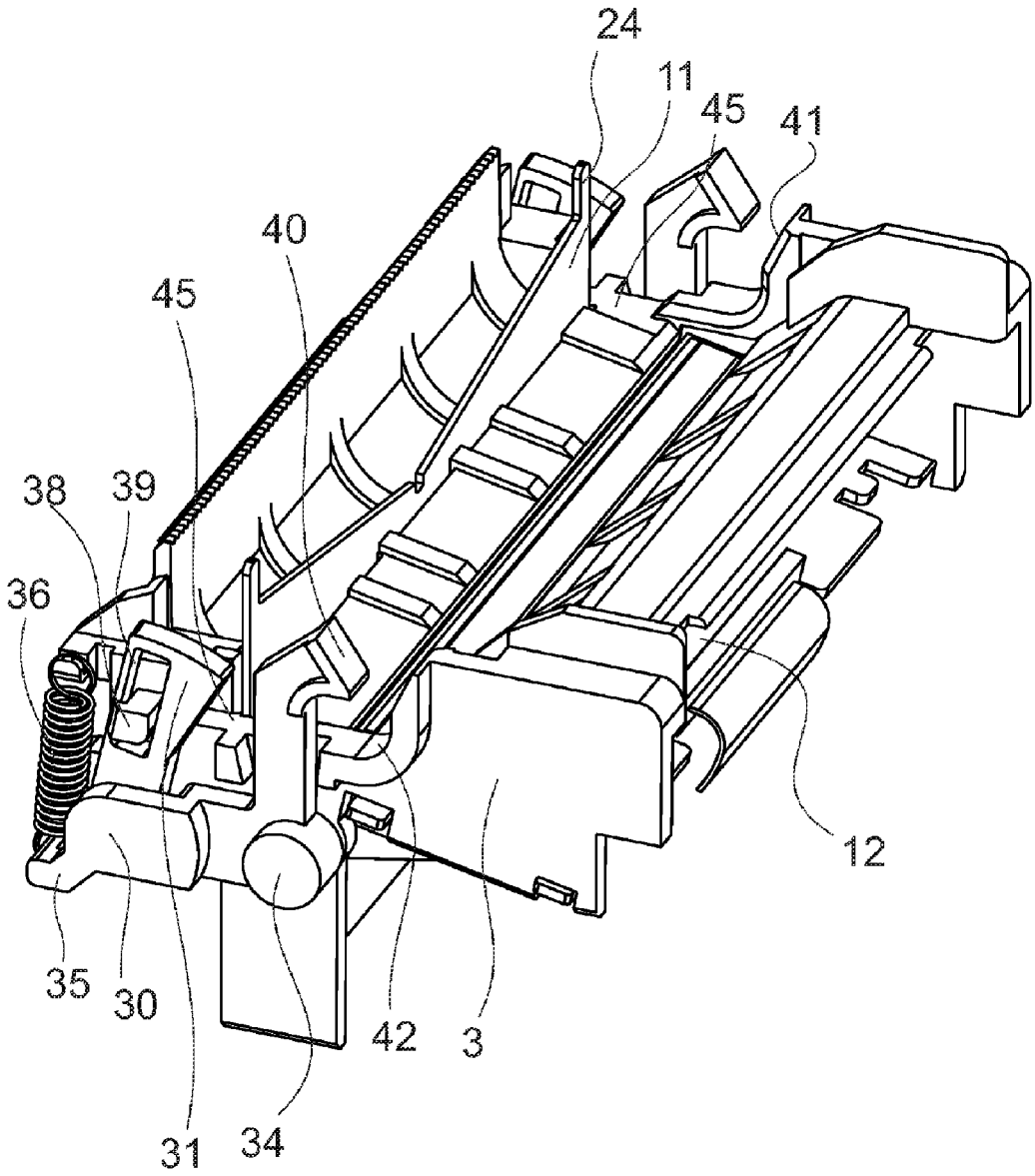
FIG. 6 shows a perspective view of first chassis from opening mechanism from thermal printer.
Figure 7:
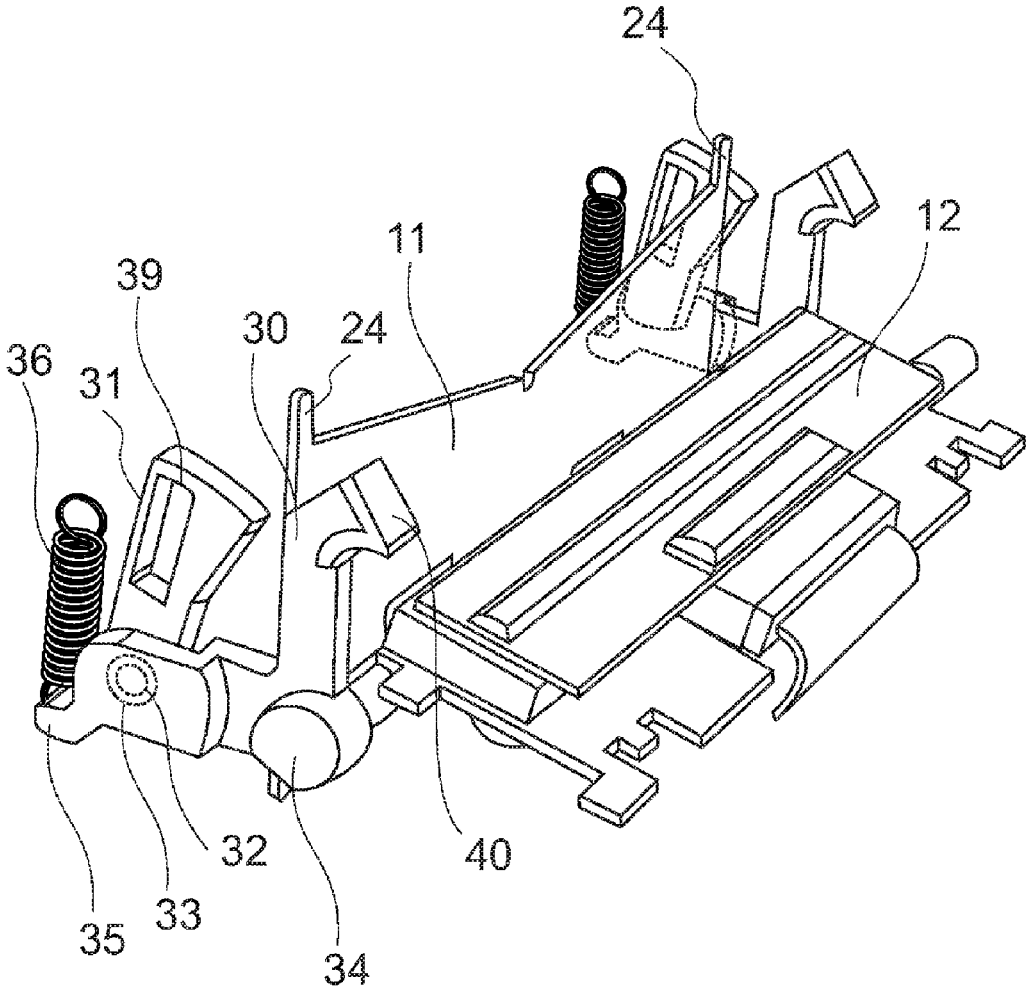
FIG. 7 shows a perspective view of the disposition of components from first chassis from opening mechanism from thermal printer.

The best mode of execution of the present invention consists of the second chassis having a small rotation movement in relation to the cover around the platen roller axis, which is articulated in relation to the cover by means of two rods, as shown in FIG. 4. Such small rotation from chassis guarantees the right settlement of the fixed blade on the movable blade. Platen roller articulation allows the right alignment in relation to the thermal head, besides allowing diminishing printer costs allowing the rest of the cover to be manufactured in a less resistant material. The first chassis is preferably fixed in relation to the printer body.

Both printing mechanism and cutting mechanism arrangements allow an innovative embodiment providing movable blade movement perpendicular to line formed between contact point between blades and spin center from printer cover.

Figure 8:
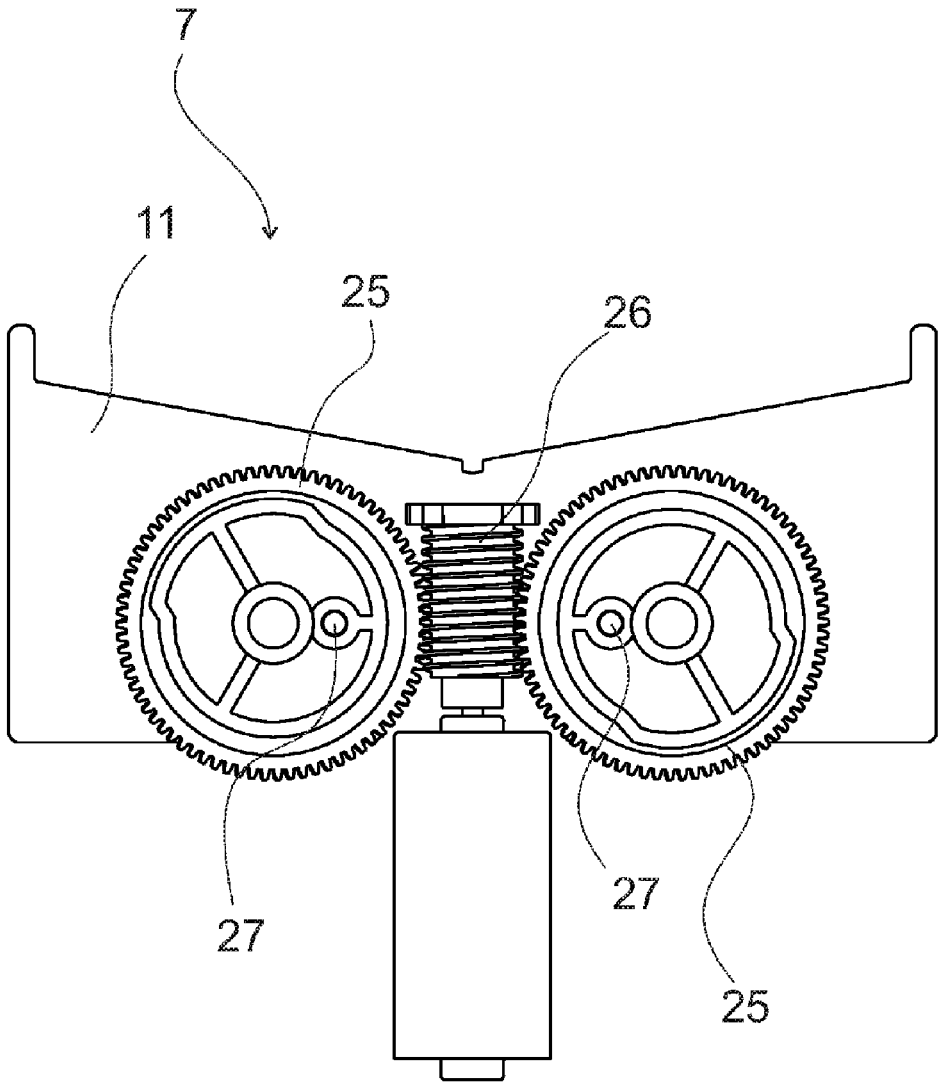
FIG. 8 shows a front view of the gears arrangements from cutting mechanism according to the best mode of execution of the present invention.
Figure 9:
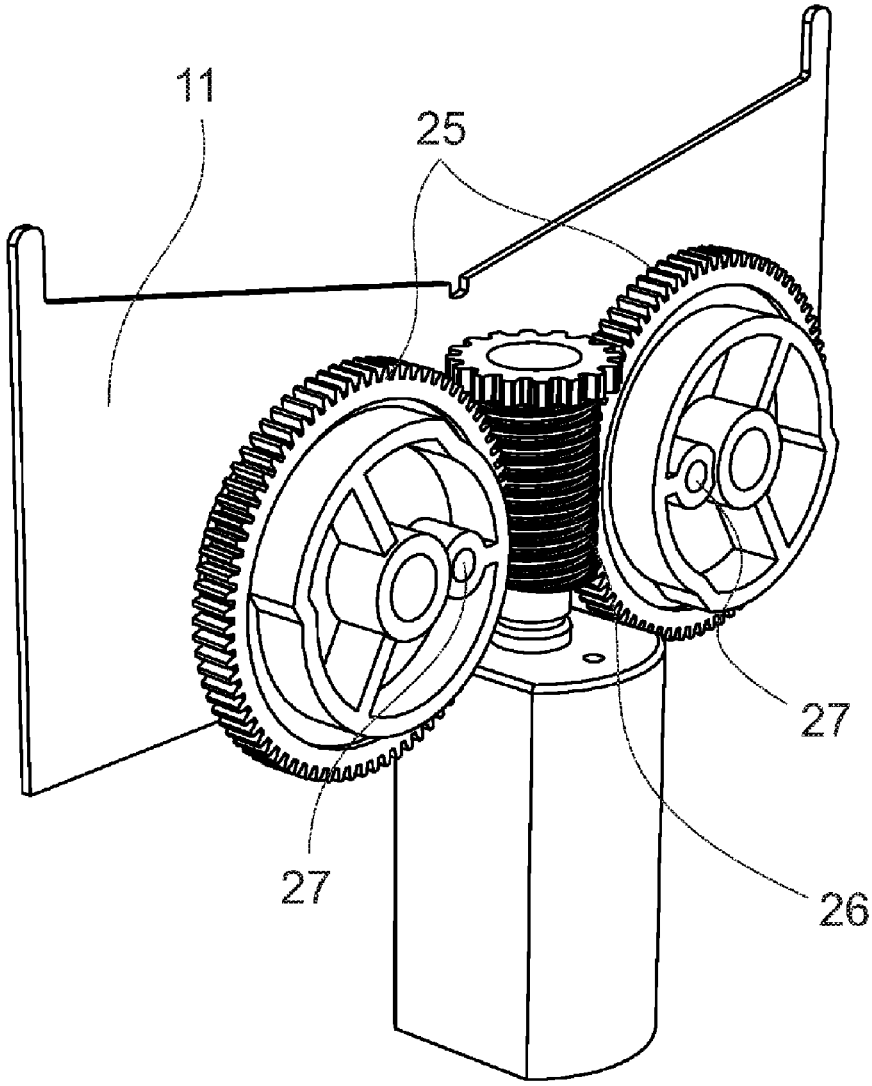
FIG. 9 shows a perspective view of the gears arrangements from cutting mechanism according to the best mode of execution of the present invention.

Besides, it is revealed an arrangement of gears of the cutting mechanism, comprising two helicoidal gears activated by endless gear disposed between two helicoidal gears, directly activating each of helicoidal gears, as showed on FIG. 8.

Such mechanism allows an increase of efficiency on motor force transmission that activates movable blade that promotes cut and, consequently avoiding undesired situations of cutting mechanism locking and increasing printer availability.

Mode for Invention

The several execution modes of the present invention are not limited to constructive details disclosed on this description and figures, as the present invention may be performed by other equivalent embodiments. According to the referred figures, the present invention refers to a thermal printer (1) with thermal printer opening mechanism (2) in two chassis, hereinafter mentioned as first chassis (3) and second chassis (4). Second chassis (4) is preferably positioned on printer cover (5), having the fixed blade (6) from cutting mechanism (7) and platen roller (8) from thermal printing mechanism (9) positioned on it, whereas first chassis (3) is preferably fixed to printer body (10) having movable blade (11) from cutting mechanism (7) and thermal head (12) from thermal printing mechanism (9) positioned on it.

In order to provide necessary locking of cover during printing and easy opening during operations such replacing paper roll, the opening mechanism (2) disclosed further comprises of a locking mechanism (13).

During printing, the paper (14) from paper roll (15) is traced by platen roller (8) that is activated by mechanism of paper forwarding comprised of a set of gears and stepper motor and, after printing, following to cutting mechanism (7). Paper roll (15) is stored in paper roll holder (16) that may be provided with small rolls for helping paper roll (15) movement during releasing of paper (14). After cutting mechanism (7), conduction channel (17) presents an upward curve to direct paper (14) for output (18) positioned on upper part of printing (1).

Thermal printing mechanism (9) is positioned with thermal head (12) approximately on horizontal position allowing direction of paper (14) for frontal part of printer (1), and platen roller (8) is positioned right above thermal head (12). Thus, printer opening and closing movement does not interfere on right positioning of platen roller (8) in relation to thermal head (12). Besides, the printed side of the paper (14) is facing upward in the output (18) that is the side wherein operator is often positioned, generating more comfort for operator. This thermal printing mechanism (9) disposition, in conjunction with disposition of paper roll holder (16), further allows printer to operate on a vertical position, for example, being able to be fixed to walls as it is usually used in restaurant kitchens. The other devices from cutting mechanism (7) and locking mechanism (13) are also adapted to allow printer functioning (1) in any position.

On frontal part, it is placed cutting mechanism (7) vertically with a slight inclination so that movement direction of movable blade (11) from cutting mechanism (7) is perpendicular to line formed between rotation axis (19) of cover (5) and contact point between two blades. Fixed blade (6) is disposed with small inclination in relation to movable blade (11) between 1° and 20° which makes cutting more efficient.

Fixed blade (6) is pressed over movable blade (11) by a spring (20), such as blade like, supported by second chassis (4) approximately over platen roller (8). In another mode of execution, spring (20) may be positioned on first chassis (3) acting over movable blade (11). In all modes of execution, fixed blade (6) is positioned on cover (5) being distanced when printer is opened in a movement in conjunction with the cover (5) itself. Thus, although being referred to as a fixed blade, in fact such blade presents movement, however, it stays fixed during normal printer operation and cutting. It was opted to refer to it as fixed blade (6) in order to facilitate understanding once in conventional mechanisms such blade is fixed; in the same way reference as movable blade (11) was kept as relative to blade that moves during cutting.

In the best mode of execution of the present invention, fixed blade (6) further has a small movement of accommodation during cover (5) opening and closing. Fixed blade (6) has supporting point (21) on upper part on second chassis (4), being supported on said supporting point (21), fixed blade (6) touches side edges (22) on side openings (23) from second chassis (4) when cover (5) is opened, due to force exerted by the spring (20). During cover closure (5), guides (24) from movable blade (11) are in touch with fixed blade (6) releasing side edges (22) from contacting side openings (23) what allows perfect positioning between blades from cutting mechanism (7). Besides, such accommodation provides an auto-balancing of cutting mechanism, making efforts between blades uniform what is essential for cutting uniformity.

The movable blade (11) may be activated by a mechanism similar to the conventional ones, with motor, preferably of continuous current, and gears for movement transmission. When activated, the movable blade (11), preferably in 'V' shape, vertically slides towards the fixed blade (6), slicing the paper (14) between the cutting surfaces of movable blade (11) and the fixed blade (6) performing the cutting of the paper (14).

In the best mode of execution of the present invention, it is used an arrangement of cutting mechanism (7) gears, comprising two helicoidal gears (25) activated by an endless gear (26) disposed between the two helicoidal gears (25), directly activating each one of the helicoidal gears (25) and thus, not having direct contact between the two helicoidal gears (25), as shown in FIG. 8.

The motor activates the endless gear (26) that transmits movement for the helicoidal gears (25). Both helicoidal gears (25) spin in relation to two axes fixed to first chassis (3), activating movable blade (11) by means of two pins (27) that are fixed on the helicoidal gears (25). As transmission is direct from endless gear (26) to each of the helicoidal gears (25), efforts over gears are lesser and also losses are minimized, besides avoiding overcharging of one of helicoidal gears, in opposition to the prior art, where the worm gear is connected to only one helical gear that transmit part of the energy to the second helical gear (25). Wastes are also lesser once efforts are better distributed. Besides, there is no need in differentiating manufacturing of both helicoidal gears (25) anymore due to transmission symmetry, opposite to conventional mechanisms in which it is common the gearing from gears to be with one endless gear and the other to be direct on first gear requiring different angles of gear's dent gearing.

Moreover, such mechanism allows an increase on efficiency of transmission of motor power that activates movable blade (11) that promotes cutting and, consequently, avoids undesired situations of cutting mechanism (7) locking, thus increases printer availability.

Additionally, on gears arrangement on cutting mechanism proposed in the best mode of execution, effort direction over motor is axial, generating less waste on motor bearings and, when operating on direction indicated on FIG. 8, effort direction coincides with direction in which motor supports stronger reaction forces.

The locking mechanism (13) comprises lever (28) and rod (29), placed on cover (5), lock (30) and actuator (31), and placed on first chassis (3).

The lever (28) is placed on cover (5), preferably side centered, being connected to second chassis (4) through rod (29) that connects lever (28) rotation axis with platen roller (8) rotation. Rod (29) is also responsible for bearing platen roller (8), defining platen roller (8) position in relation to thermal head (12).

Coupling between actuator (31) and lock (30) is provided by means of pin (32) of lock (30) fitting with actuator (31) hole (33). Lock (30) is preferably in 'L' shape requiring less force to be applied on arm edge to obtain same torque to cause rotation, wherein rotation from said lock (30) is performed around rotation axis (34) fixed in relation to first chassis (3). Near lock (30) pin (32) it is placed a fitting (35) in which it is coupled a spring (36). Said spring (36) has another edge locked to first chassis (3) and, thus, generates lock (30) subjection force providing, this way, correct positioning of platen roller (8) on first chassis (3). As additional functions, this spring (36) weakens lock (30) and cover (5) movement during printer closure, as well as provides lock (30) return, and, consequently, also the actuator (31) and lever (28) to initial position. The other edge of lock (30) has a '1'-like-shape, acting as a hook to provide platen roller (8) locking in relation to thermal head (12). In another mode of execution, actuator (31) may be suppressed and the lever adapted to directly activate lock (30).

In order to provide a better distribution of efforts during printer (1) opening and closing, it is preferably disposed a mechanism equivalent to depicted on the other side of printer (1). The locking mechanisms (13) of each one of sides are independent, providing some freedom between both locks (30). Such independence is important because allows compensation of small manufacturing errors, what is important to guarantee that the efforts the lock (30) exerts over the rod (29) are similar in both sides of printer, providing the same relative positioning between platen roller (8) and thermal head (12), and consequently, providing a uniform printing.

Figure 12:
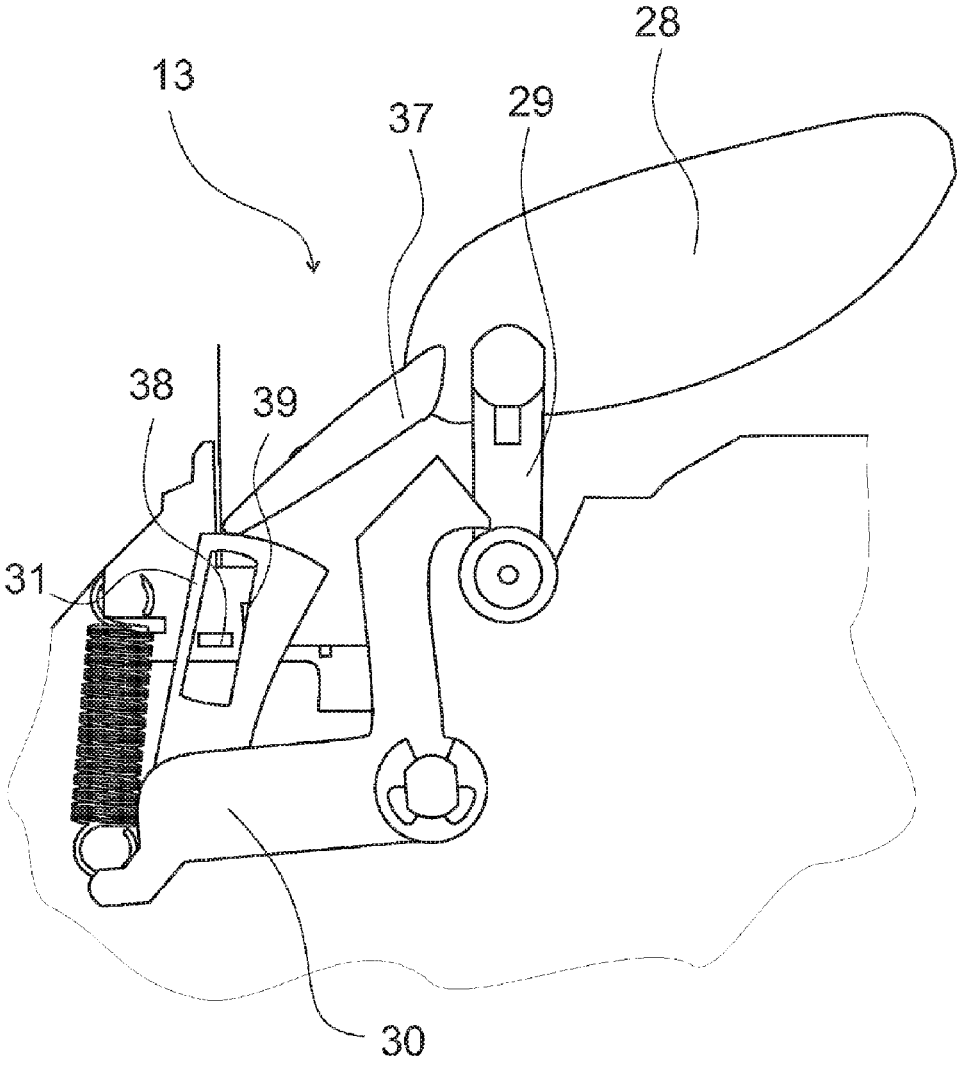
FIG. 12 shows a side view of the locking mechanism during the beginning of the printer opening.
Figure 13:
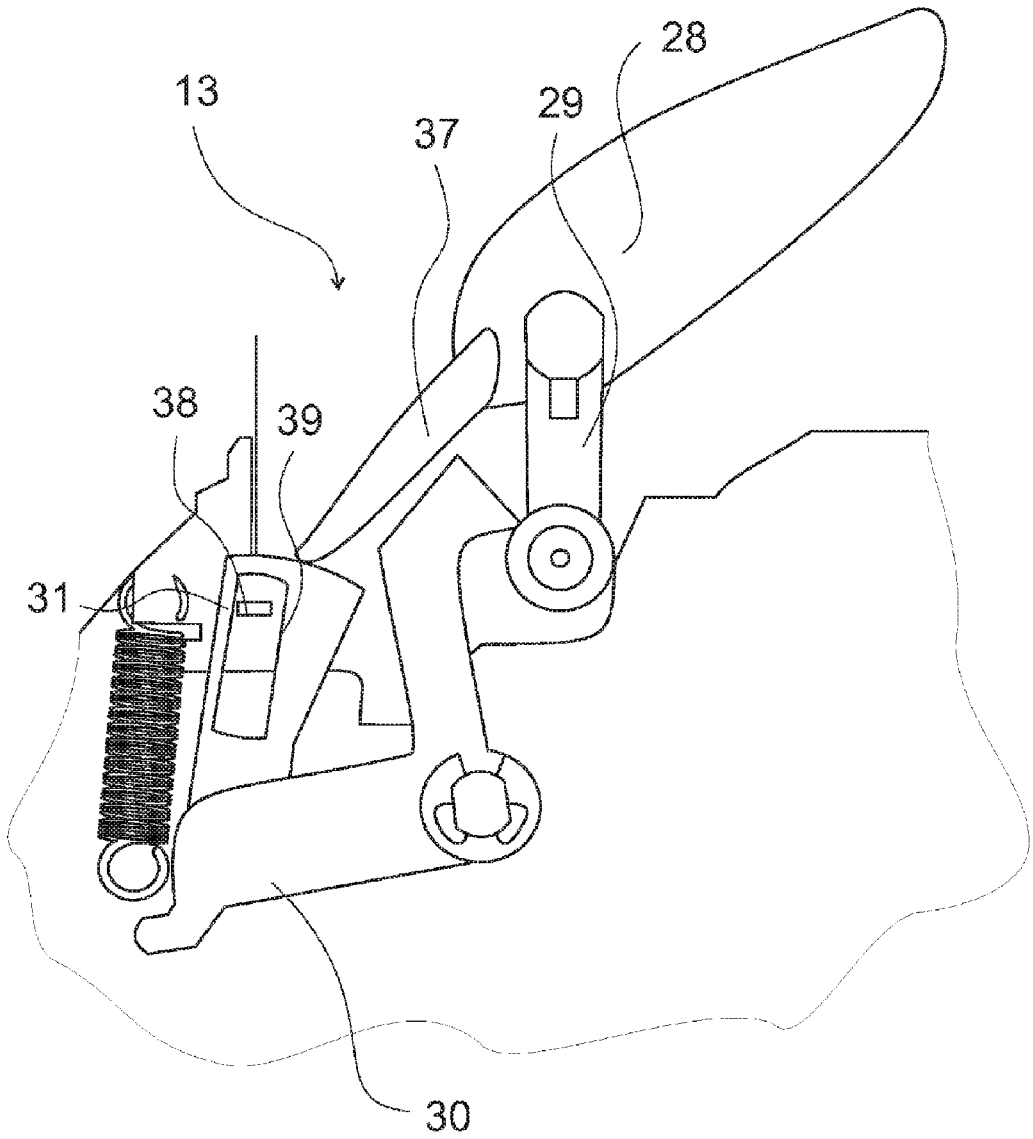
FIG. 13 shows a side view of the locking mechanism during the intermediate step of the beginning of the printer opening.
Figure 14:
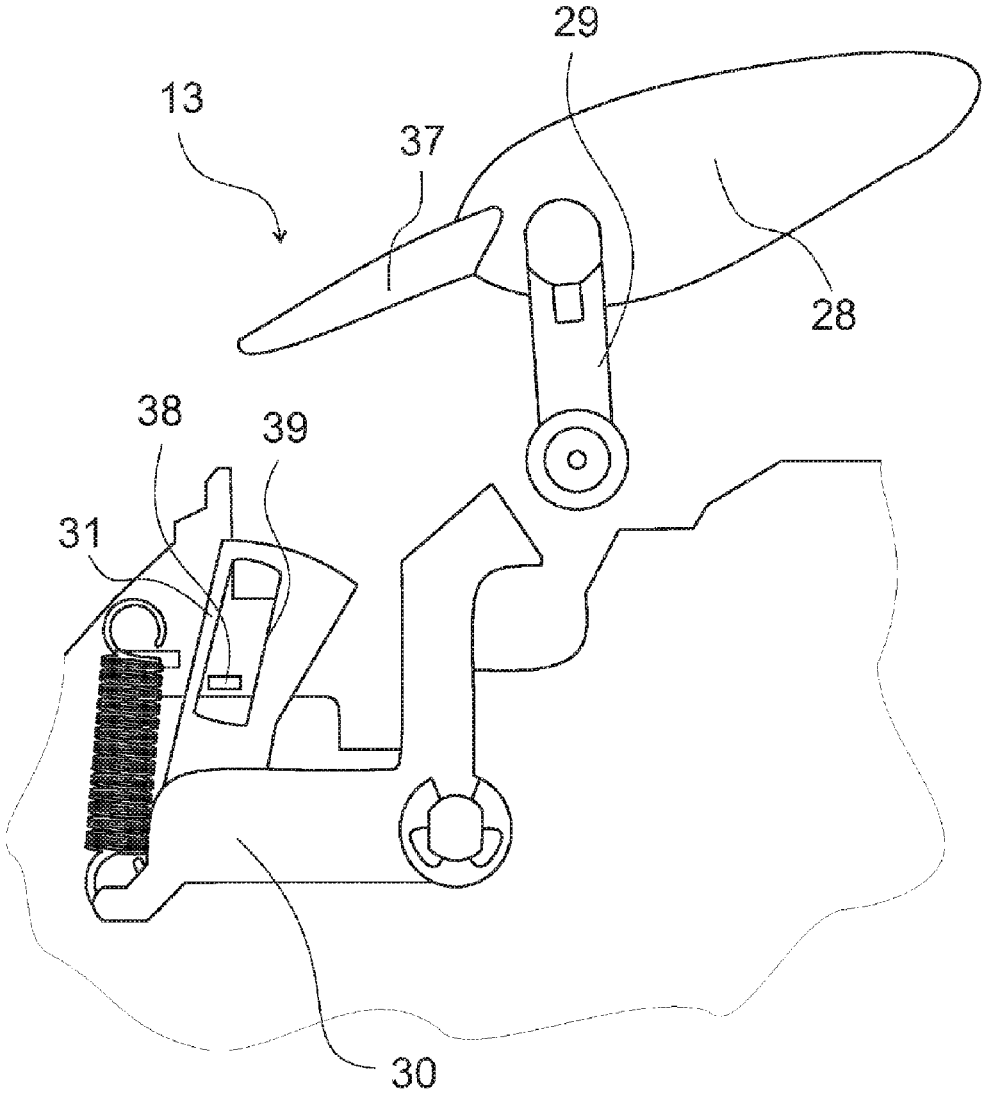
FIG. 14 shows a side view of the locking mechanism during the ending of the printer opening.
Figure 15:
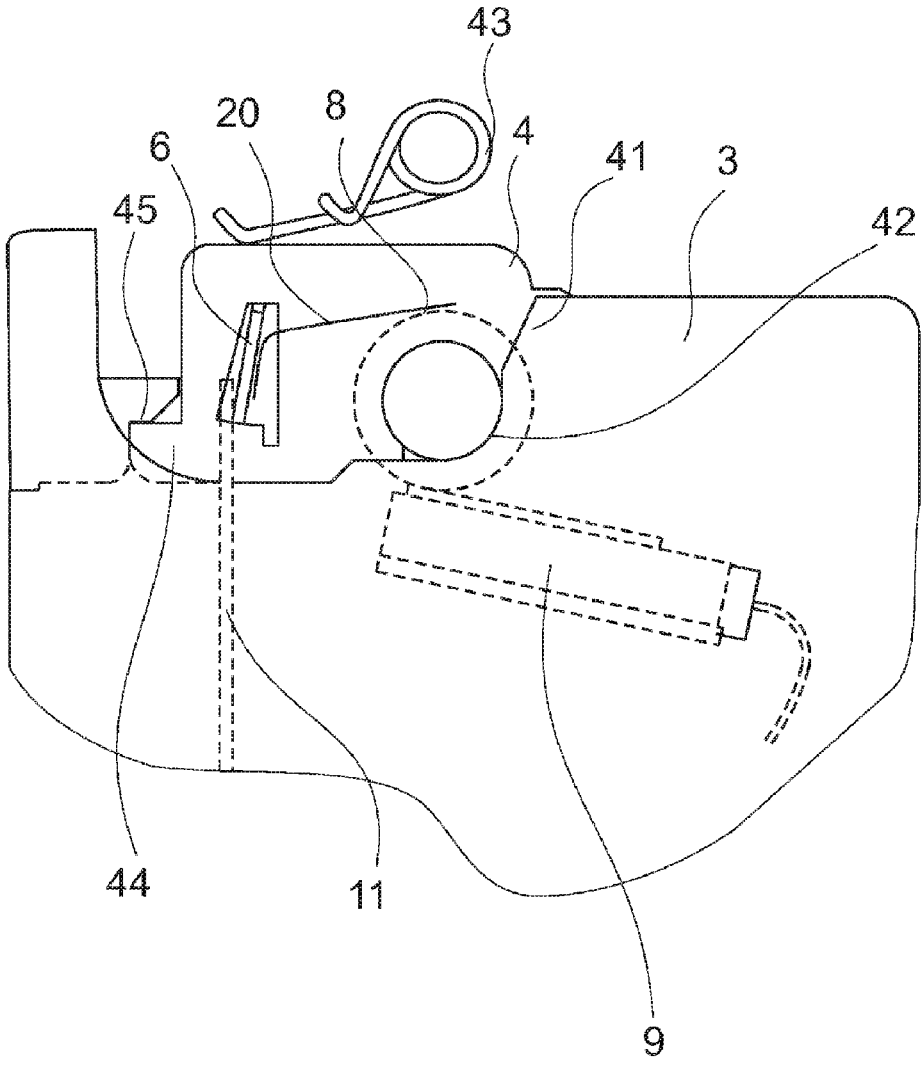
FIG. 15 shows a side view of the opening mechanism of the thermal printer according to the best mode of execution with mechanism components from hidden locking mechanism.
Figure 16:
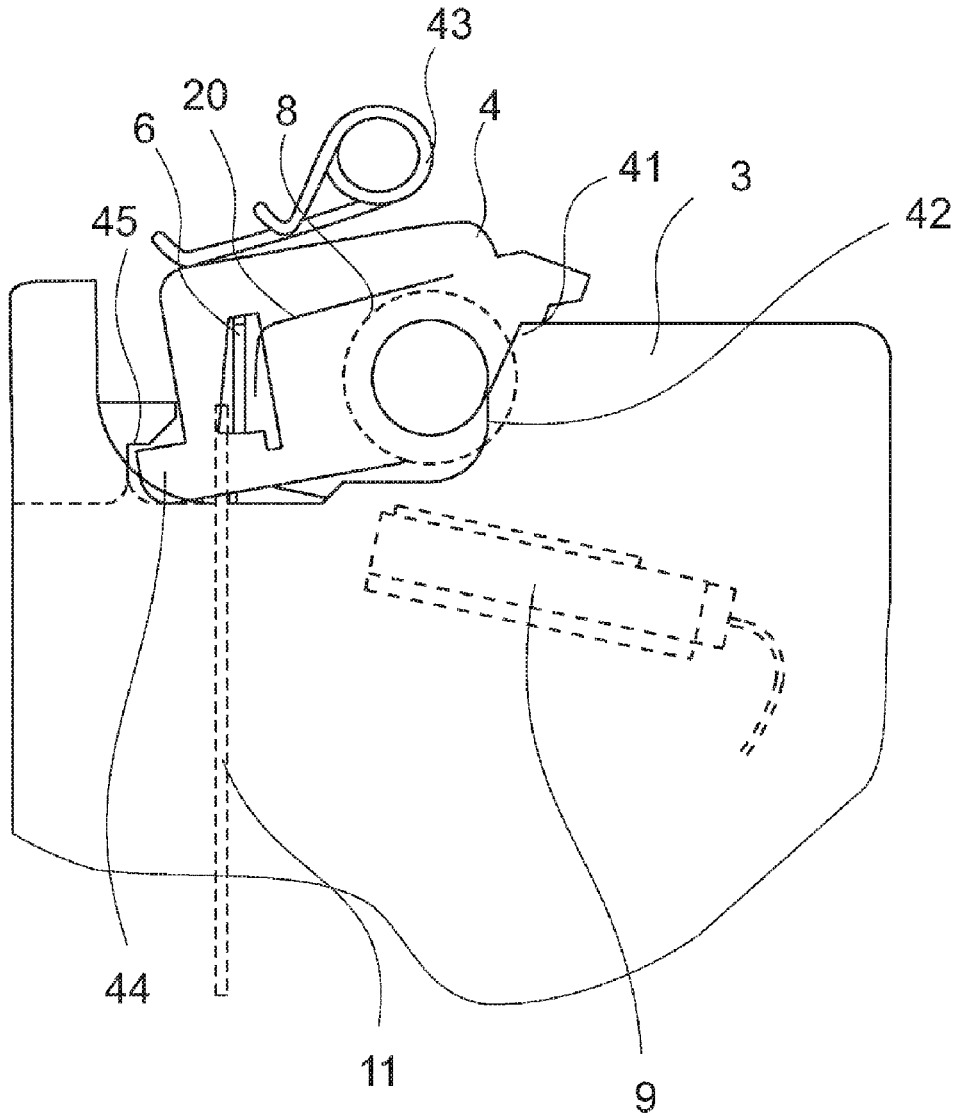
FIG. 16 shows a side view of the opening mechanism of the thermal printer according to the best mode of execution during the beginning of the printer opening with components from hidden locking mechanism.
Figure 17:
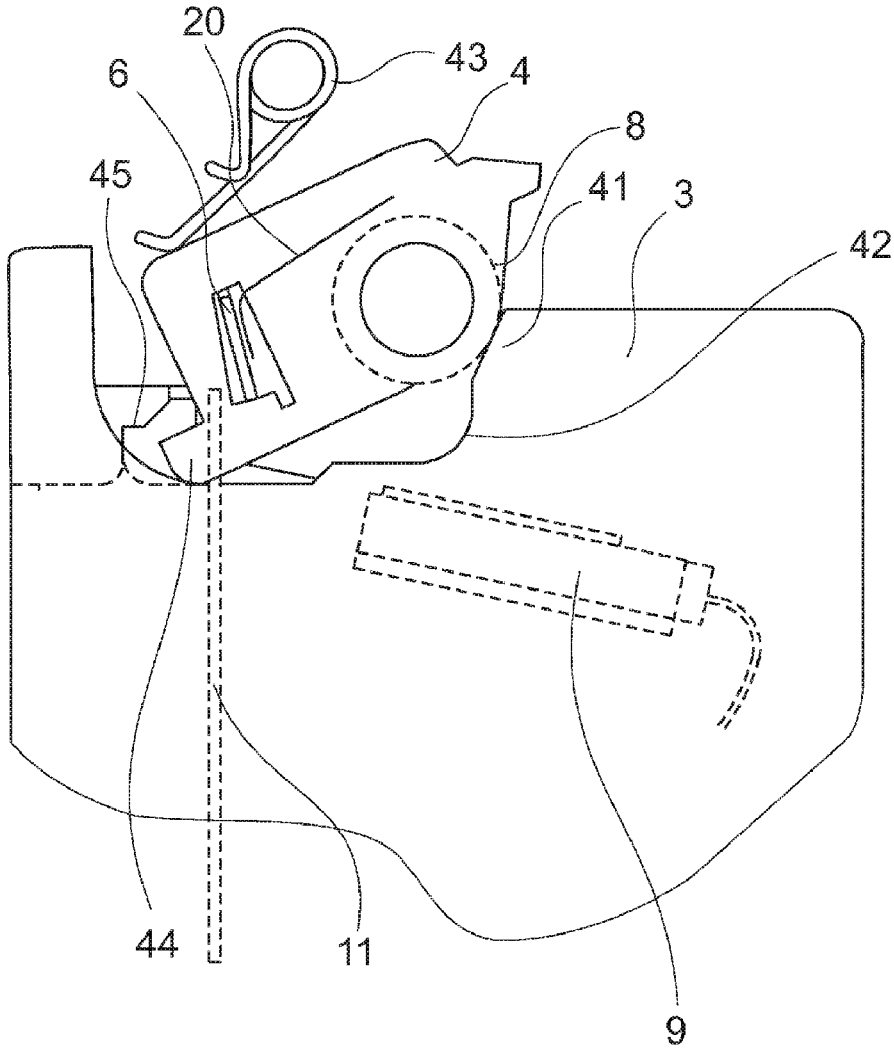
FIG. 17 shows a side view of the opening mechanism of the thermal printer according to the best mode of execution, during the intermediate step of the printer opening with components from hidden locking mechanism.

FIGS. 12, 13 and 14 present the printer (1) opening. When lever (28) is activated by the operator, activation projection (37) from lever (28) pushes actuator (31) downwards, which, then, rotates the lock (30), releasing printer (1) opening. Movement from actuator (31) is guided by projection (38) sliding on opening (39) of said actuator (31).

During printer (1) closure, rod (29) is pressed against inclined surface (40) of lock (30) also sliding over the inclined surface (41) on first chassis (3), causing lock (30) rotation on the same direction of rotation performed during opening, allowing platen roller (8) accommodation on paper roll holder (42) on first chassis (3) what provides right position for printer (1) functioning. Afterwards, lock (30) returns to initial position providing cover (5) closure. Platen roller holder (42) on first chassis (3) has approximately 'L' shape what provides absorption of horizontal efforts generated by subjection cutter spring (20) of fixed blade (6) once it is also perpendicular to line formed between rotation axis (19) from cover (5) and contact point between two blades, also diminishing efforts over lock (30).

Besides, rotation axis (19) from cover (5) opening and closing from printer (1) is placed a little lower than conventional position, providing easy printer opening even when cutting mechanism (7) self-locking occurs, once, this way, cutting mechanism (7) may be placed in an almost vertical position and further approximately perpendicular to line formed between rotation axis (19) from cover (5) and contact point between blades from cutting mechanism (7).

Thus, in case there is cutting mechanism (7) locking, operator may freely open printer (1) withdrawing element that caused said locking, for example, scrunched paper. When cover (5) is opened, movable blade (11) is automatically retracted to avoid being exposed to operator. Afterwards, operator may normally close printer (1) and continue printing.

Figure 10:
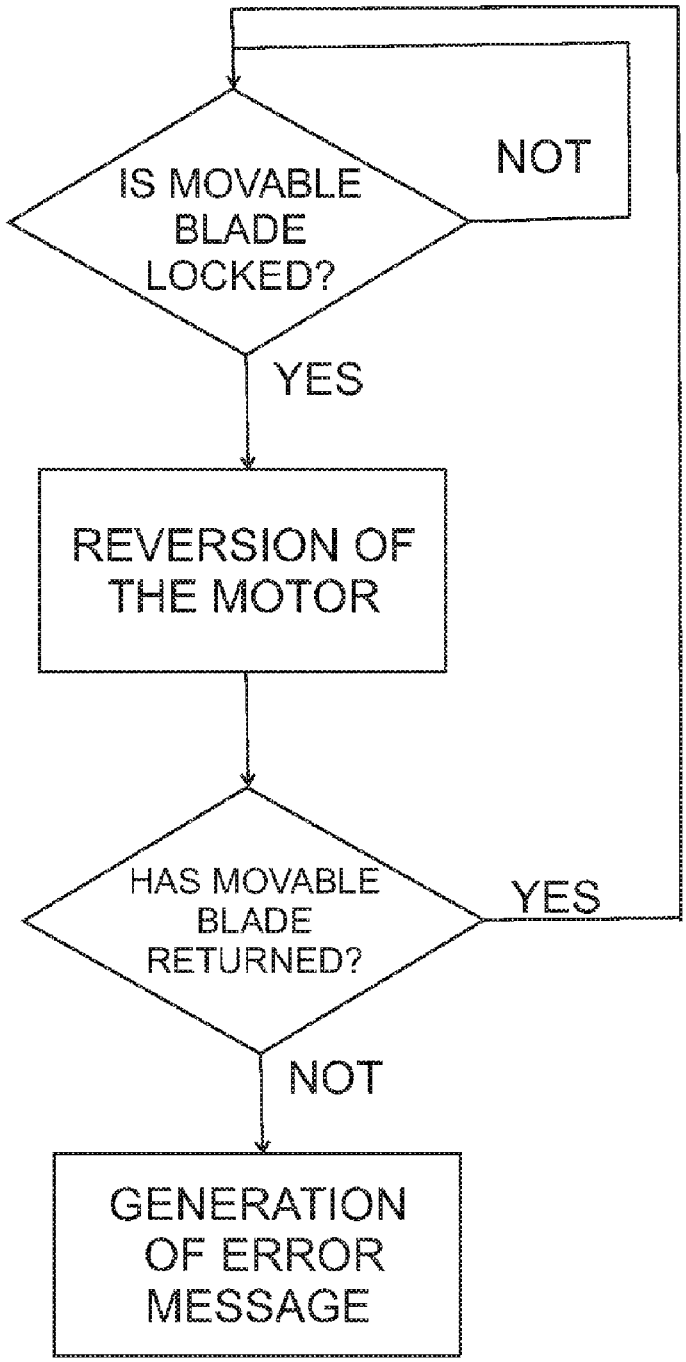
FIG. 10 shows a process of monitoring movable blade locking.
Figure 11:
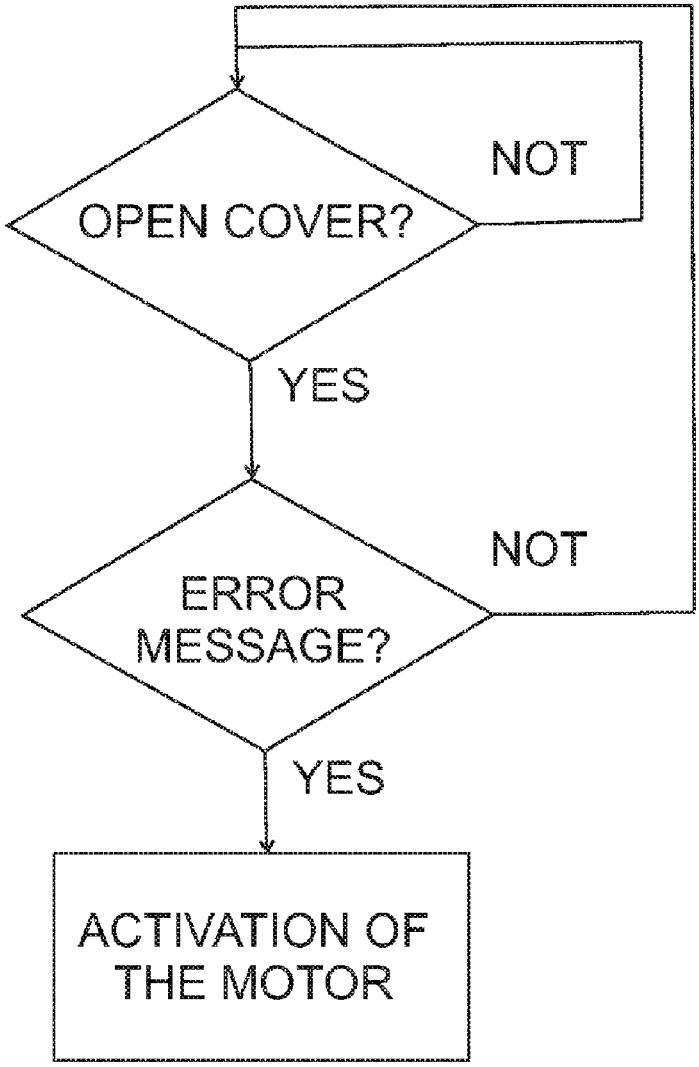
FIG. 11 shows a process of automatic activation of the movable blade in case of locking.

Automatic activation of movable blade (11) provides operator safety during cover (5) opening. As shown in FIG. 10, when there is a movable blade (11) locking, movable blade (11) activation motor is automatically reverted trying to return movable blade (11) to resting position. In case it is not possible to return movable blade (11) it is generated an error message informing operator about the cutter operation failure. As showed in FIG. 11, when opening sensor from cover (5) detects that the operator opened the printer (1), it sends a signal to the control board that verifies if there is any error message referred to cutting mechanism (7) locking. If it is detected that the movable blade (11) is still in a forward position, the motor of cutting mechanism (7) is activated, providing the retraction of the movable blade (11). When the cover (5) is opened, there are no longer efforts generated by fixed blade (6) over movable blade (11), allowing easy return of the cutting mechanism (7) to the resting position, avoiding any accident touch of the operator fingers to the cutting edges of the cutting blades.

In case the operator has turned off the equipment due to an error message, he/she can normally open and close the printer (1) even when the movable blade (11) is locked.

In the best mode of execution of the present invention, during printer (1) opening, the platen roller (8) stays fixed in relation to the cover (5), as shown in FIGS. 15, 16, 17, and 18. When the cover is opened, the platen roller (8) is displaced in a circular movement upwards, in conjunction with the lever (29) and the cover (5), as soon as the lock (30) releases this movement. During this movement, the second chassis (4) suffers a small rotation around the axis of platen roller (8) and the fixed blade (6) attached to the second chassis, is released from the movable blade (11) of the cutting mechanism (7).

This small rotation from the second chassis (4) in relation to the cover (5) is done towards the opposite direction of the cover (5) opening rotation, providing a small displacement of the fixed blade (6) from the cutting mechanism (7). This is important to allow a free opening of printer cover (5), even when the movable blade (11) is in the upward position.

Figure 18:
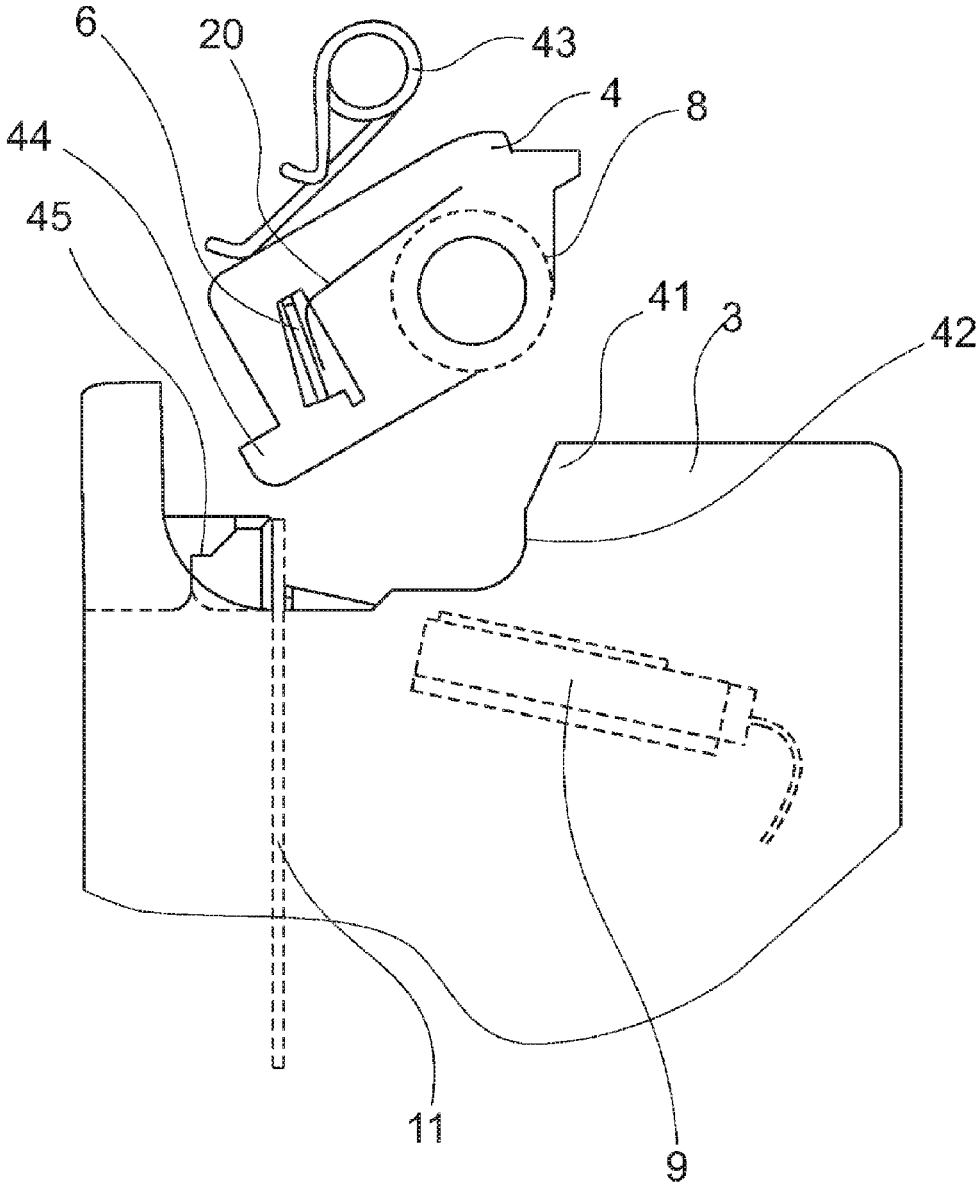
FIG. 18 shows a side view of the opening mechanism of thermal printer according to the best mode of execution at the end of the printer opening with components from hidden locking mechanism.

While cover (5) stays opened, the second chassis spring (43), preferably of torsion, keeps the second chassis (4) slightly inclined in relation to the cover (5) according to FIG. 18. On printer (1) closure, the first part of second chassis (4) to be in touch with the first chassis (3) is a locking projection (44) that slide on a surface of the first chassis (3), forcing a rotation of the second chassis (4). Such rotation makes the fixed blade (6) from cutting mechanism (7) to be smoothly in touch with the movable blade (11). Such movement presses the fixed blade (6) against the movable blade (11), being fixed blade (6) supported just by supporting point (21) from second chassis (4) and on guides (24) from movable blade (11) providing a proper position for cutting. Locking projections (44) from second chassis (4) slid on the first chassis (3) until they fit on a vertical support (45) from the first chassis (3). Such fitting aims to retain the vertical effort resulted from the forces that occur during the movement of the blade (11) and the shear forces produced during a cut. It also prevents the second chassis (4) to spin, distancing the fixed blade (6) from the movable blade (11). At the same time, the platen roller (8) slides over surface (41) and distances the lock (30) as previously disclosed and printer (1) closure is concluded.

INDUSTRIAL APPLICABILITY

The present invention finds wide industrial application in mechanisms of printing or marking of a continuous material such as paper roll, followed by cutting like points of sale printers.

The invention claimed is:

1. A thermal printer, comprising:

a first chassis fixed to a body of the thermal printer, the first chassis having a movable blade of a cutting mechanism of the thermal printer and a thermal print head of a thermal printing mechanism of the thermal printer positioned on the first chassis;

a second chassis positioned on a cover of the thermal printer having a fixed blade of the cutting mechanism and a platen roller of the thermal printing mechanism positioned on the second chassis; and a locking mechanism comprising a lever and a rod placed on the cover, and a lock and an actuator placed on the first chassis;

wherein the thermal printing mechanism is positioned with the thermal print head in an approximately horizontal position and the platen roller is positioned right above the thermal print head; and wherein the cutting mechanism is vertically positioned with a slight inclination so that a direction of movement of the movable blade of the cutting mechanism is perpendicular to a line formed between a rotation axis of the cover and a contact point between the movable blade and the fixed blade of the cutting mechanism.

2. The thermal printer according to claim 1, wherein the rotation axis of the cover is placed at approximately a same height as the contact point between the movable blade and the fixed blade of the cutting mechanism.

3. A thermal printer, comprising:

a first chassis fixed to a body of the thermal printer, the first chassis having a movable blade of a cutting mechanism of the thermal printer and a thermal print head of a thermal printing mechanism of the thermal printer positioned on the first chassis;

a second chassis positioned on a cover of the thermal printer having a fixed blade of the cutting mechanism and a platen roller of the thermal printing mechanism positioned on the second chassis; and a locking mechanism comprising a lever and a rod placed on the cover, and a lock and an actuator placed on the first chassis;

wherein the thermal printing mechanism is positioned with the thermal print head in an approximately horizontal position and the platen roller is positioned right above the thermal print head;

wherein the cutting mechanism is vertically positioned with a slight inclination so that a direction of movement of the movable blade of the cutting mechanism is perpendicular to a line formed between a rotation axis of the cover and a contact point between the movable blade and the fixed blade of the cutting mechanism;

wherein the fixed blade is supported by an upper part of the second chassis and subjected to a spring, the spring being supported by the second chassis approximately above the platen roller;

wherein side edges of the fixed blade are supported on side surfaces of openings in the second chassis when the cover is opened; and wherein the side edges of the fixed blade are distanced from the side surfaces of the openings of the second chassis when the cover is closed, the fixed blade being pushed by guides of the movable blade.

4. A thermal printer, comprising:

a first chassis fixed to a body of the thermal printer, the first chassis having a movable blade of a cutting mechanism of the thermal printer and a thermal print head of a thermal printing mechanism of the thermal printer positioned on the first chassis;

a second chassis positioned on a cover of the thermal printer having a fixed blade of the cutting mechanism and a platen roller of the thermal printing mechanism positioned on the second chassis; and a locking mechanism comprising a lever and a rod placed on the cover, and a lock and an actuator placed on the first chassis;

wherein the thermal printing mechanism is positioned with the thermal print head in an approximately horizontal position and the platen roller is positioned right above the thermal print head;

wherein the cutting mechanism is vertically positioned with a slight inclination so that a direction of movement of the movable blade of the cutting mechanism is perpendicular to a line formed between a rotation axis of the cover and a contact point between the movable blade and the fixed blade of the cutting mechanism; and wherein the cutting mechanism includes a gear arrangement consisting of two helicoidal gears and an endless gear, the endless gear being disposed between the two helicoidal gears over a symmetry axis of the cutting mechanism and the two helicoidal gears being symmetrically arranged, each of the two helicoidal gears being directly activated by the endless gear.

5. A thermal printer, comprising:

a first chassis fixed to a body of the thermal printer, the first chassis having a movable blade of a cutting mechanism of the thermal printer and a thermal print head of a thermal printing mechanism of the thermal printer positioned on the first chassis;

a second chassis positioned on a cover of the thermal printer having a fixed blade of the cutting mechanism and a platen roller of the thermal printing mechanism positioned on the second chassis; and a locking mechanism comprising a lever and a rod placed on the cover, and a lock and an actuator placed on the first chassis;

wherein the thermal printing mechanism is positioned with the thermal print head in an approximately horizontal position and the platen roller is positioned right above the thermal print head;

wherein the cutting mechanism is vertically positioned with a slight inclination so that a direction of movement of the movable blade of the cutting mechanism is perpendicular to a line formed between a rotation axis of the cover and a contact point between the movable blade and the fixed blade of the cutting mechanism; and wherein activation of the cutting mechanism comprises steps of:

activating an endless gear using a motor;

activating movement of two helicoidal gears using the endless gear;

rotating each respective helicoidal gear of the two helicoidal gears around a respective axis fixed to the first chassis;

activating movement of two pins that are coupled to the movable blade in response to rotation of each respective helicoidal gear; and activating movement of the movable blade towards the fixed blade in response to the activating movement of the two pins.

6. A thermal printer according to claim 5, wherein automatic activation of the movable blade comprises steps of:

a controller board of the printer activating the motor to reverse when the movable blade locks to return the movable blade to a resting position;

the controller board of the thermal printer generating an error message in case it is not possible to return the movable blade to the resting position;

the controller board of the thermal printer performing error message verification when an operator opens the cover of the thermal printer; and the controller board of the thermal printer activating the motor to retract the movable blade to the resting position when it is detected that the movable blade is still in a forward position.

7. A thermal printer, comprising:

a first chassis fixed to a body of the thermal printer, the first chassis having a movable blade of a cutting mechanism of the thermal printer and a thermal print head of a thermal printing mechanism of the thermal printer positioned on the first chassis;

a second chassis positioned on a cover of the thermal printer having a fixed blade of the cutting mechanism and a platen roller of the thermal printing mechanism positioned on the second chassis; and a locking mechanism comprising a lever and a rod placed on the cover, and a lock and an actuator placed on the first chassis;

wherein the thermal printing mechanism is positioned with the thermal print head in an approximately horizontal position and the platen roller is positioned right above the thermal print head;

wherein the cutting mechanism is vertically positioned with a slight inclination so that a direction of movement of the movable blade of the cutting mechanism is perpendicular to a line formed between a rotation axis of the cover and a contact point between the movable blade and the fixed blade of the cutting mechanism;

wherein the lever of the locking mechanism is connected to the second chassis by the rod that connects a rotation axis of the lever to a rotation axis of the platen roller, wherein the rotation axis of the lever is supported on the rod;

wherein the actuator and the lock of the locking mechanism are coupled by a pin that fits within a hole of the actuator;

wherein the lock has an 'L' shape with movement around a rotation axis that is fixed in relation to the first chassis, the lock having a fitting near the pin by which it is coupled to a first end of a traction spring a second end of the spring being locked to the first chassis;

wherein an end of the lock that is distant from the pin has a '1'-like-shape and locks the rod in relation to the first chassis; and wherein the locking mechanism is duplicated on each side of the printer with each operating independently of the other.

8. A thermal printer according to claim 7 wherein the actuator is incorporated into the lever forming a single part, so that the lever directly activates the lock with no intermediate parts.

9. A thermal printer, comprising:

a first chassis fixed to a body of the thermal printer, the first chassis having a movable blade of a cutting mechanism of the thermal printer and a thermal print head of a thermal printing mechanism of the thermal printer positioned on the first chassis;

a second chassis positioned on a cover of the thermal printer having a fixed blade of the cutting mechanism and a platen roller of the thermal printing mechanism positioned on the second chassis; and a locking mechanism comprising a lever and a rod placed on the cover, and a lock and an actuator placed on the first chassis;

wherein the thermal printing mechanism is positioned with the thermal print head in an approximately horizontal position and the platen roller is positioned right above the thermal print head;

wherein the cutting mechanism is vertically positioned with a slight inclination so that a direction of movement of the movable blade of the cutting mechanism is perpendicular to a line formed between a rotation axis of the cover and a contact point between the movable blade and the fixed blade of the cutting mechanism; and wherein the second chassis is articulated relative to the cover.

10. A thermal printer according to claim 9, wherein opening of the cover comprises steps of:

an operator activating the lever;

an activation projection of the lever pushes the actuator downwards;

the actuator generates rotation of the lock;

rotation of the lock releases the cover of the thermal printer; and movement of the actuator is guided by the activation projection sliding in an opening of the actuator.

11. A thermal printer according to claim 9, wherein closure of the cover comprises steps of:

the rod sliding on an inclined surface on the first chassis and pushing an inclined surface of the lock;

the rod activating rotation of the lock in a same direction of rotation as performed during opening of the cover; and the lock retuning to its initial position;

wherein the rod fits in a cradle of the first chassis having an 'L' shape.

12. A thermal printer according to claim 10, wherein opening of the cover comprises steps of:

moving the lever to release the locking mechanism;

moving the platen roller, the lever, the rod, and the cover in a circular upwards movement;

rotating the second chassis around an axis of the platen roller in a direction opposite rotation of the cover, wherein the fixed blade of the cutting mechanism initially stays resting in relation to the movable blade of the cutting mechanism; and retracting the fixed blade of the cutting mechanism relative to the movable blade of the cutting mechanism and moving towards the rotation axis of the cover;

wherein the cover opens in a circular movement around the rotation axis of the cover, and wherein a spring, preferably in torsion, keeps the second chassis slightly inclined in relation to the cover.

13. A thermal printer according to claim 11, wherein closure of the cover comprises steps of:

the second chassis being slightly inclined in relation to the cover under the action of a spring, preferably in torsion;

the fixed blade on the second chassis pressing guides of the movable blade on the first chassis;

the fixed blade being pressed in relation to the movable blade;

locking projections on the second chassis sliding on the first chassis;

the rod sliding on a surface of the first chassis distancing the lock;

the locking projections fitting into vertical supports of the first chassis;

the second chassis rotating in a direction opposite to the cover movement; and the rod fitting into the cradle of the first chassis.

14. A thermal printer, comprising:

a first chassis fixed to a body of the thermal printer, the first chassis having a movable blade of a cutting mechanism of the thermal printer and a thermal print head of a thermal printing mechanism of the thermal printer positioned on the first chassis;

a second chassis positioned on a cover of the thermal printer having a fixed blade of the cutting mechanism and a platen roller of the thermal printing mechanism positioned on the second chassis; and a locking mechanism comprising a lever and a rod placed on the cover, and a lock and an actuator placed on the first chassis;

wherein the thermal printing mechanism is positioned with the thermal print head in an approximately horizontal position and the platen roller is positioned right above the thermal print head;

wherein the cutting mechanism is vertically positioned with a slight inclination so that a direction of movement of the movable blade of the cutting mechanism is perpendicular to a line formed between a rotation axis of the cover and a contact point between the movable blade and the fixed blade of the cutting mechanism; and wherein automatic activation of the movable blade comprises steps of:

a controller board of the printer activating the motor to reverse when the movable blade locks to return the movable blade to a resting position;

the controller board of the thermal printer generating an error message in case it is not possible to return the movable blade to the resting position;

the controller board of the thermal printer performing error message verification when an operator opens the cover of the thermal printer; and the controller board of the thermal printer activating the motor to retract the movable blade to the resting position when it is detected that the movable blade is still in a forward position.

15. A thermal printer, comprising:

a first chassis fixed to a body of the thermal printer, the first chassis having a movable blade of a cutting mechanism of the thermal printer and a thermal print head of a thermal printing mechanism of the thermal printer positioned on the first chassis;

a second chassis positioned on a cover of the thermal printer having a fixed blade of the cutting mechanism and a platen roller of the thermal printing mechanism positioned on the second chassis; and a locking mechanism comprising a lever and a rod placed on the cover, and a lock and an actuator placed on the first chassis;

wherein the thermal printing mechanism is positioned with the thermal print head in an approximately horizontal position and the platen roller is positioned right above the thermal print head;

wherein the cutting mechanism is vertically positioned with a slight inclination so that a direction of movement of the movable blade of the cutting mechanism is perpendicular to a line formed between a rotation axis of the cover and a contact point between the movable blade and the fixed blade of the cutting mechanism; and wherein opening of the cover comprises steps of:

an operator activating the lever;

an activation projection of the lever pushes the actuator downwards;

the actuator generates rotation of the lock;

rotation of the lock releases the cover of the thermal printer; and movement of the actuator is guided by the activation projection sliding in an opening of the actuator.

16. A thermal printer, comprising:

a first chassis fixed to a body of the thermal printer, the first chassis having a movable blade of a cutting mechanism of the thermal printer and a thermal print head of a thermal printing mechanism of the thermal printer positioned on the first chassis;

a second chassis positioned on a cover of the thermal printer having a fixed blade of the cutting mechanism and a platen roller of the thermal printing mechanism positioned on the second chassis; and a locking mechanism comprising a lever and a rod placed on the cover, and a lock and an actuator placed on the first chassis;

wherein the thermal printing mechanism is positioned with the thermal print head in an approximately horizontal position and the platen roller is positioned right above the thermal print head;

wherein the cutting mechanism is vertically positioned with a slight inclination so that a direction of movement of the movable blade of the cutting mechanism is perpendicular to a line formed between a rotation axis of the cover and a contact point between the movable blade and the fixed blade of the cutting mechanism; and wherein closure of the cover comprises steps of:

the rod-sliding on an inclined surface on the first chassis and pushing an inclined surface-of the lock;

the rod activating rotation of the lock in a same direction of rotation as performed during opening of the cover; and the lock retuning to its initial position; and wherein the rod fits in a cradle of the first chassis having an 'L' shape.

* * * * *